US011600398B1

(12) United States Patent
Almae

(10) Patent No.: US 11,600,398 B1
(45) Date of Patent: Mar. 7, 2023

(54) HANDHELD DEVICE FOR REMOVING RADIOACTIVE SPILLS

(71) Applicant: GIFTEDNESS AND CREATIVITY COMPANY, Safat (KW)

(72) Inventor: Nuha H. F. H. Almae, Safat (KW)

(73) Assignee: GIFTEDNESS AND CREATIVITY COMPANY, Safat (KW)

( * ) Notice: Subject to any disclaimer, the term of this patent is extended or adjusted under 35 U.S.C. 154(b) by 0 days.

(21) Appl. No.: 17/860,851

(22) Filed: Jul. 8, 2022

(51) Int. Cl.

| | |
|---|---|
| ***G21F 9/22*** | (2006.01) |
| ***G21F 9/06*** | (2006.01) |
| ***G21F 5/06*** | (2006.01) |
| ***G21F 5/002*** | (2006.01) |
| ***G21F 9/00*** | (2006.01) |

(52) U.S. Cl.
CPC ..... *G21F 9/22* (2013.01); *G21F 5/002* (2013.01); *G21F 5/06* (2013.01); *G21F 9/001* (2013.01); *G21F 9/06* (2013.01)

(58) Field of Classification Search
CPC ... G21F 9/22; G21F 5/002; G21F 5/06; G21F 9/001; G21F 9/06
USPC ..... 15/320
See application file for complete search history.

(56) References Cited

U.S. PATENT DOCUMENTS

| | | | |
|---|---|---|---|
| 4,061,480 | A | 12/1977 | Frye et al. |
| 4,796,311 | A | 1/1989 | Shankman |
| 5,273,561 | A | 12/1993 | Zeren |
| 5,301,388 | A | 4/1994 | Zeren |
| 5,846,334 | A | 12/1998 | Hoce |
| 5,970,572 | A | 10/1999 | Thomas |
| 6,125,498 | A | 10/2000 | Roberts et al. |
| 9,754,692 | B2 | 9/2017 | Yoshida et al. |
| 2017/0101752 | A1 | 4/2017 | McCallum |

FOREIGN PATENT DOCUMENTS

| | | | |
|---|---|---|---|
| CN | 101732341 | A | 6/2010 |

OTHER PUBLICATIONS

Guizzo, "Robot Vacuum Sucks Up Radiation at Fukushima Plant," © Copyright 2019 IEEE, Jul. 7, 2011.

*Primary Examiner* — Edward M Johnson
(74) *Attorney, Agent, or Firm* — Nath, Goldberg & Meyer; Richard C. Litman

(57) ABSTRACT

A system and method of clearing radioactive contamination from a surface is provided by means of a handheld device and a method of using the handheld device. The handheld device has a manual system which operates by pressing a button to spray radioactive wash on the surface. The handheld device also has an electrical system which operates by pressing a button to suction radioactive contamination from the surface. The function of this system is to clean the surface from radioactive contamination. The system of the handheld device consists of a suctioning part and a pump and functions by suctioning the radioactive contamination into a lead cylinder, from which it is easily disposed. A third component includes a gauge for detecting contamination before, during, and after the cleaning and suctioning processes of the handheld device.

12 Claims, 3 Drawing Sheets

HANDHELD DEVICE FOR REMOVING RADIOACTIVE SPILLS

BACKGROUND

1. Field

The disclosure of the present patent application relates to the cleanup of radioactive contamination. For example, in nuclear medicine departments or hospital imaging stations, radioactive contamination can occur throughout every stage in the imaging process and therefore would require cleanup in multiple areas such as the injection room, stress room, camera room and/or hot lab. Currently, the regularly occurring contamination is cleaned by workers with radioactive wash and a piece of sponge and gauze in a process that is labor intensive and can be potentially harmful to the workers.

2. Description of the Related Art

Cleanup of radioactive material is addressed in the art. For example, U.S. Pat. No. 4,061,480 provides a vacuum cleaner having a head section housing a motor and a fan. The head section sits on top of a filter unit comprising a filter cartridge, and a bag that comprises a primary filter for the cartridge. The filter unit is contained within a bladder that is impervious to air. Intake to the cleaner comprises an intake port connected to the area enclosed by the bladder. In this way, the material collected by the vacuum cleaner may be disposed of by unitary removing of the bladder and the filter unit.

The problem of hazardous material cleanup of wet or dry material has been addressed in the art. For example, U.S. Pat. No. 4,894,881 provides an open top base reservoir that contains a collection bag, the collection bag being used only for dry cleanup situations. An adapter unit sits on top of the base member. The upper portion of the adapter unit contains a vacuum motor that draws air from within the collection bag, first through a cloth filter bag, and then through a HEPA filter. A ball valve is positioned between the collection bag and the cloth filter bag to interrupt air flow when the base member is full of wet or liquid material.

U.S. Pat. No. 3,894,364 relates to the general field of the cleaning of contaminated areas, such as nuclear power plants. The prior art has provided dust collectors having multiple compartments. For example, U.S. Pat. No. 4,718,924 describes a two compartment, four stage, dust collector. In this device, dust-laden air passes sequentially through a cyclone stage, a solids/gas separation stage, and a four-canister filter stage.

While these devices are generally suitable for their diverse intended purposes, such as in situations of low radiation level, the need remains in the art for a critically safe volume vacuum cleaner for use in the wet or dry cleanup of radioactive workspaces.

The machine of this disclosure will be the first machine of a handheld and compact nature that can be used to clean radioactive contamination in general workplace environments. Currently, there are no devices that can clean radioactive contamination as with this machine which stands a marked improvement of the current way of hand cleaning with sponges and radioactive spray washes. Additionally, after each sponge and wash cycle workers have to use a radioactivity detector to measure the remaining activity to ensure that the particular working space is contamination free. What is presented herein, is a three in one machine that will save time, increase safety, and improve cleanup efficacy.

SUMMARY

The device, system and method for cleanup of radioactive contamination provides a vacuum cleaner or pickup device that is constructed and arranged to ensure that collected radioactive material is accumulated in a disposable container, such as by way of non-limiting example, a plastic bag. A primary use for the handheld device constructed and arranged herein is the manual cleanup of either wet or dry radioactive material.

In an embodiment, the vacuum pickup of the disclosure is generally achieved by use of the handheld device of the disclosure. In certain embodiments, the handheld device may have an L-shaped or pistol shaped housing including a handgrip section as shown in FIG. 1. The compact nature of the device is a marked improvement over other cleanup devices which, while portable, can be more cumbersome to use in the radioactive cleanup process. In addition, the device can further include a built-in contamination gauge to provide on-site contamination readings during or even after a cleanup procedure to ensure that a contaminated space is ready and safe for future uses.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
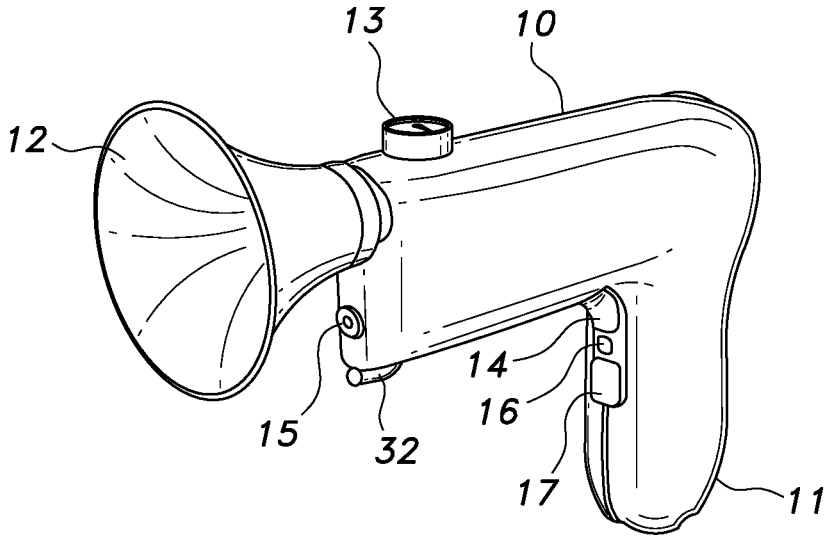
FIG. 1 is a perspective view from the suction cup side of the handheld device for radioactive cleanup.
Figure 2:
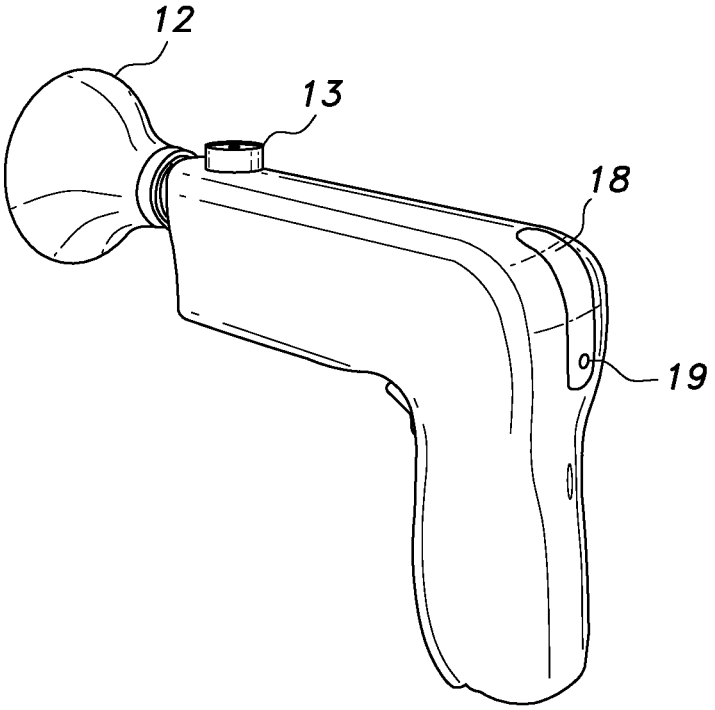
FIG. 2 is a perspective view from the handgrip side of the handheld device for radioactive cleanup.
Figure 3:
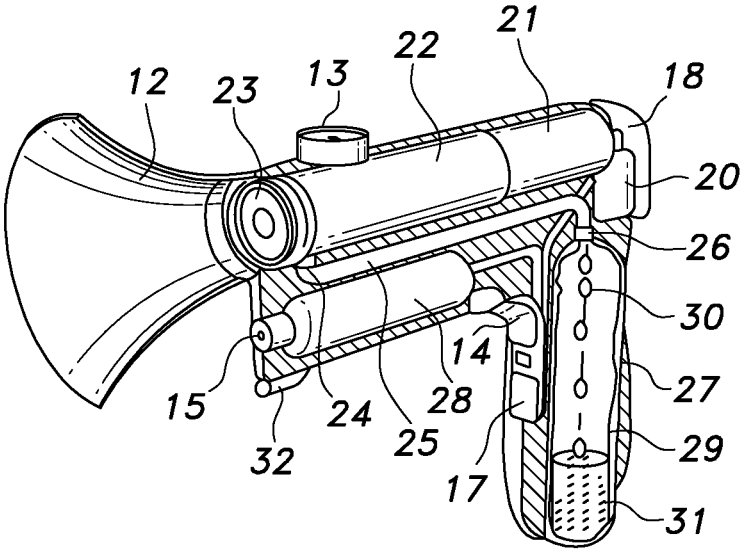
FIG. 3 provides a first internal view of the handheld device for radioactive cleanup.
Figure 4:
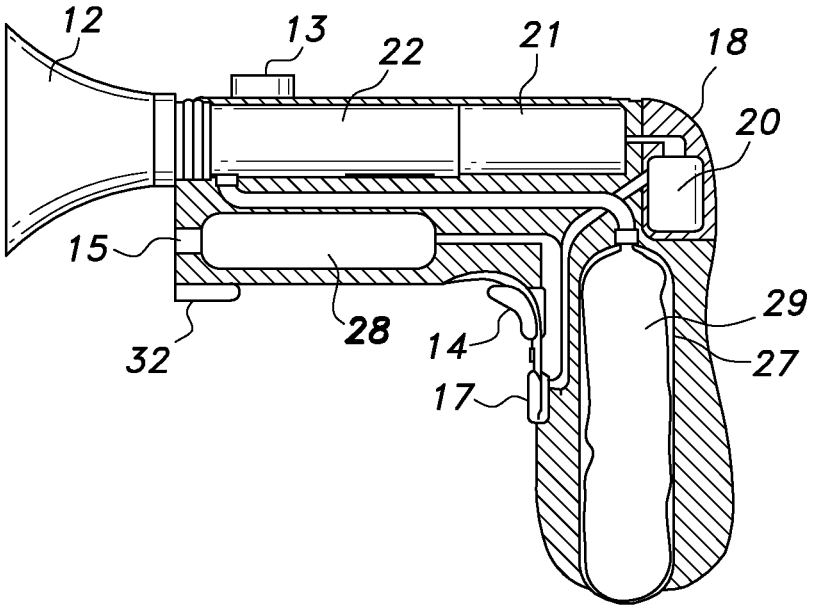
FIG. 4 is a side profile view of the internal components of the handheld device for radioactive cleanup.
Figure 5:
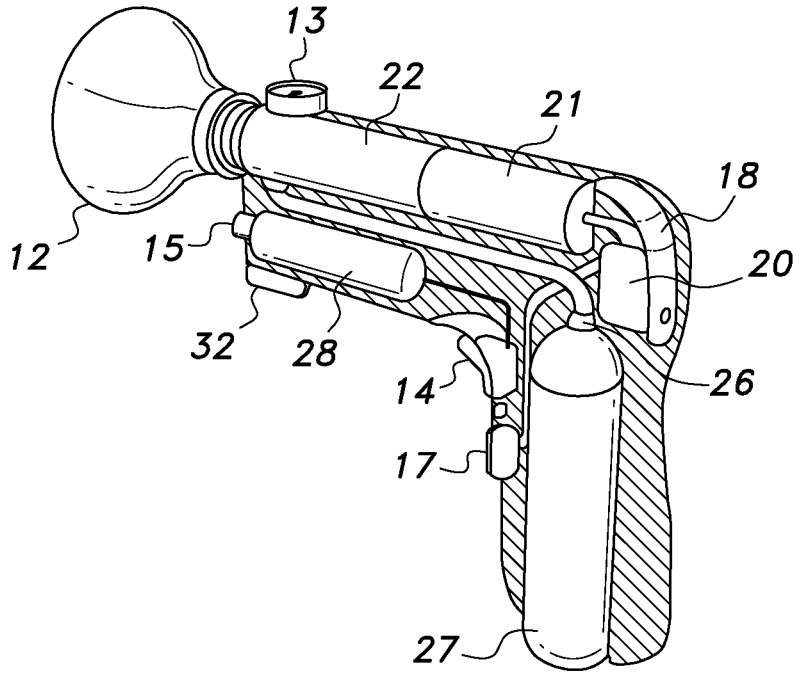
FIG. 5 provides a second internal view of the parts of the handheld device for radioactive cleanup.
Figure 6:
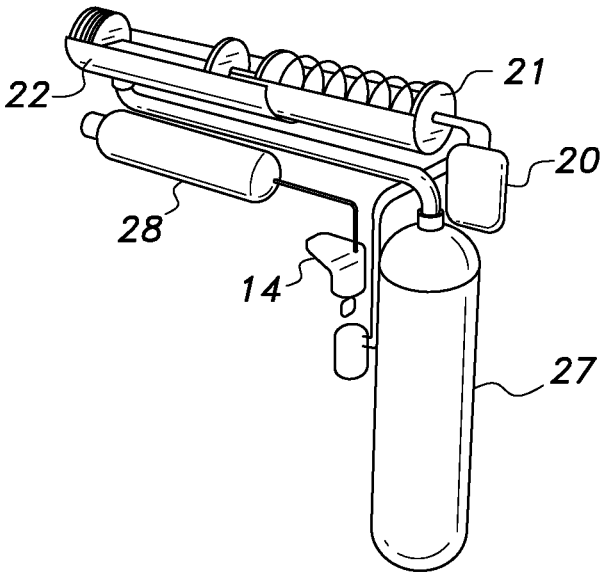
FIG. 6 provides a third internal view of the handheld device for radioactive cleanup including a view of the Besten pump, rechargeable battery, and lead cylinder.
Figure 7:
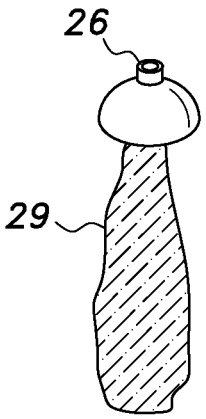
FIG. 7 is a view of a contamination bag typically located inside the lead cylinder.

As stated, the handheld device of this disclosure provides a construction and arrangement ensuring that collected radioactive material is accumulated in a manner providing a critically safe capacity. While the intended use of this handheld device is not to be considered as a limitation thereon, in one embodiment this handheld device is intended for use in the manual cleanup of either wet or dry radioactive material or contamination, such as may periodically exist in radioactive material workspaces. As will be apparent in accordance with the present disclosure, collected radioactive material is maintained in multiple volumes whose individual and overall shapes comprises a critically safe capacity.

As used herein, the term "radioactive wash" refers to a decontamination solution designed to rapidly control radioactive contamination and remove radioactive particles from surfaces. By way of non-limiting example, one specific product falling within the scope of a "radioactive wash" as used herein is "Radiacwash" manufactured by Biodex Medical Systems and other similar products.

The present handheld device consists of two subsystems working in concert, said subsystems being a manual system and an electrical system. The electrical system may be powered by a battery, for example, a rechargeable battery (20). The manual system includes spray wash button (14), spray nozzle (15), and radioactive wash container (28). The manual system is activated by pressing spray wash button (14) and has a main function of removing the radioactive contamination from a contaminated surface by spraying radioactive wash on the surface. The electrical system is activated by pressing power button (17) and operates by suctioning radioactive contamination from the surface and storing the radioactive contamination in a disposable container (29). This disposable container (29) is stored inside a lead cylinder (27) to reduce the possibility of further contamination. The use of lead is very important as it isolates the radiation from the removed radioactive contamination.

The electrical system consists of an inlet valve for liquid contamination (23), lead cylinder (27), battery (20), filter, radioactive contamination tube (25), and a power button (17). It operates by pressing the power button (17) to operate the handheld device. This will engage the suction pump (21) to suction the radioactive contamination from a contaminated surface, through a suction cup (12) attached to a front end of a suctioning part (22). The suctioned radioactive contamination can then travel from the suctioning part (22) through a radioactive contamination tube (25) before collecting inside a disposable bag (29) residing in the lead cylinder (27) in the device. Any suctioned air leaves the device through a filter. The suctioning part (22) can be connected to the radioactive contamination tube (25) at a bottom surface of the suctioning part (22) via a threaded screw (24), thereby funneling the radioactive contamination from said suctioning part (22) through said contamination tube (25).

In one embodiment, the handheld device comprises a housing (10) having a topmost section and a handgrip section (11). In this embodiment, the topmost section contains a suctioning part (22), a suction pump (21), a radioactive contamination tube (25), a radioactive wash container (28), and a spray nozzle (15). The handgrip section contains a lead cylinder (27) for storing collected radioactive contamination, a disposable container (29) inside the lead cylinder (27) for collecting and removing radioactive contamination from the handheld device, a lock button (16), a power button (17), and a spray wash button (14).

The handheld device operates with ease and is lightweight and compact and is designed to be ergonomically graspable within the palm of the technician's enclosed hand when in use due to the pistol shaped housing (10) of the handheld device. In principle, the device works by suctioning the contamination from the contaminated surfaces by means of the suction cup (12) when pressing the power button (17). A Besten pump (21) will go back and open the inlet valve (23) to collect the radioactive contamination in the suction part (22). The radioactive contamination (31) will pass through the radioactive contamination tube (25) to the storage lead cylinder (27) that contains within a disposable container, for example, a plastic disposable bag (29). The radioactive contamination tube (25) can be connected to the storage lead cylinder (27) and/or the disposable container (29) using a screw (26). The collected radioactive contamination will enter the disposable container (29), and thus the lead cylinder (27) in the form of contamination drops (30) until it collects as radioactive contamination (31). The lead cylinder (27) may be removable to allow for easy disposal of the disposable container (29).

After suctioning the contamination, the handheld device initiates a cleaning process by pressing the spray wash button (14) and accordingly the radioactive wash that is stored in the radioactive wash container (28) will spray from the spray nozzle (15) to help clean and remove the radioactive contamination from the contaminated surface. In some embodiments, the radioactive wash container may be a removable plastic container. In certain embodiments, the handheld device will repeat this suctioning/spray/clean cycle twice during normal usage.

After the cleaning process, the handheld device allows for the technician to ascertain any existing contamination by using a radioactive gauge detector (32) to measure any remaining activity and display the radiation count by the reader (13) located in the top of machine. The radioactivity spray wash process is initiated by a spray button (14) which disperses a radioactive spray wash from a radioactive wash container (28) containing a refillable amount of radioactive wash. The handheld device also has a lock button (16) which locks the operation of the handheld device when not in use. A battery (20), for example a rechargeable battery, which powers the suction pump (21) and provides power for the gauge is located behind the Besten pump (21) and suctioning part (22) and is accessible by a cover plate (18) for replaceable batteries or can be charged while remaining within the handheld device by a charge point (19) for rechargeable batteries. In another embodiment, the present subject matter relates to a method for removing radioactive contamination from a surface, the method comprising activating a handheld device as described herein for cleanup of radioactive contamination, wherein said activating comprises:

a) suctioning the radioactive contamination from the surface through the suction cup into the handheld device;

b) spraying the surface with spray wash through said spray wash nozzle;

c) measuring remaining radioactivity on the surface using the radiation gauge detector and the radiation count reader;

d) repeating steps a)-c) if said radiation count reader shows a level of remaining radioactivity on the surface above a preset limit; and e) safely disposing said disposable plastic container having the suctioned radioactive contamination therein.

It is to be understood that the handheld device for radioactive cleanup is not limited to the specific embodiments described herein but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A handheld device for cleanup of radioactive contamination, comprising a housing including:

a) a topmost section containing a suctioning part, a suction pump, a radioactive contamination tube, a radioactive wash container, and a spray nozzle;

b) a handgrip section containing a lead cylinder for storing collected radioactive contamination, a disposable container inside the lead cylinder for collecting and removing radioactive contamination from the handheld device, a lock button, a power button, and a spray wash button; and c) a suction cup attached to a front end of said suctioning part of said topmost section through which said radioactive contamination is removed from a contaminated surface and drawn into the handheld device.

2. The handheld device for cleanup of radioactive contamination, as recited in claim 1, wherein said topmost section further includes a radioactive gauge detector for detecting a residual level of radioactive contamination and a radiation count reader for providing an amount of said radioactive contamination for display to a technician.

3. The handheld device for cleanup of radioactive contamination, as recited in claim 1, wherein said suction pump suctions said radioactive contamination into said suctioning part.

4. The handheld device for cleanup of radioactive contamination, as recited in claim 3, wherein one end of said contamination tube is attached to a bottom surface of said suctioning part in said topmost section and funnels said radioactive contamination from said suctioning part through said contamination tube to said disposable container inside said lead cylinder in said handgrip section.

5. The handheld device for cleanup of radioactive contamination, as recited in claim 4, wherein said power button when pressed powers on said handheld device by providing power to said suction pump.

6. The handheld device for cleanup of radioactive contamination, as recited in claim 1, wherein said lock button when pressed locks the handheld device and prevents operation of said handheld device.

7. The handheld device for cleanup of radioactive contamination, as recited in claim 3, wherein said lead cylinder tank is removable and is connected to a second end of said contamination tube.

8. The handheld device for cleanup of radioactive contamination, as recited in claim 1, wherein said spray button when pressed sprays a radioactive wash from the radioactive wash container through the spray nozzle onto a contaminated surface to initiate a cleaning cycle of said handheld device.

9. The handheld device for cleanup of radioactive contamination, as recited in claim 1, further comprising a rechargeable battery that is rechargeable by a charge point located at a back surface of said topmost section.

10. The handheld device for cleanup of radioactive contamination, as recited in claim 1, further comprising an inlet valve between the suction cup and the suctioning part.

11. The handheld device for cleanup of radioactive contamination, as recited in claim 1, wherein said disposable container is made of plastic.

12. A method for removing radioactive contamination from a surface, the method comprising activating the handheld device for cleanup of radioactive contamination of claim 2, wherein said activating comprises:

a) suctioning the radioactive contamination from the surface through the suction cup into the handheld device;

b) spraying the surface with spray wash through said spray wash nozzle;

c) measuring remaining radioactivity on the surface using the radiation gauge detector and the radiation count reader;

d) repeating steps a)-c) if said radiation count reader shows a level of remaining radioactivity on the surface above a preset limit; and e) safely disposing said disposable plastic container having the suctioned radioactive contamination therein.

* * * * *